US007832180B2

(12) United States Patent
Dolby

(10) Patent No.: US 7,832,180 B2
(45) Date of Patent: Nov. 16, 2010

(54) JOINING STRUCTURE

(75) Inventor: Jeffrey Scott Dolby, Buford, GA (US)

(73) Assignee: Alcoa Inc., Pittsburgh, PA (US)

( * ) Notice: Subject to any disclaimer, the term of this patent is extended or adjusted under 35 U.S.C. 154(b) by 108 days.

(21) Appl. No.: 12/246,008

(22) Filed: Oct. 6, 2008

(65) Prior Publication Data

US 2010/0083596 A1 Apr. 8, 2010

(51) Int. Cl.
*E04C 3/30* (2006.01)

(52) U.S. Cl. ..... 52/848; 52/235

(58) Field of Classification Search ..... 52/848, 52/204.5, 204.62, 204.68, 204.7, 204.591, 52/204.593, 204.6, 656.5, FOR. 128, 585.1; 403/292

See application file for complete search history.

(56) References Cited

U.S. PATENT DOCUMENTS 3,267,627 A * 8/1966 Hammitt ..... 52/298
3,407,561 A * 10/1968 Henry ..... 52/656.9
3,645,569 A * 2/1972 Reilly ..... 403/4
3,743,332 A * 7/1973 Sonolet ..... 403/172
3,759,623 A * 9/1973 Hesse ..... 403/298
3,912,405 A * 10/1975 Katt ..... 403/2
4,269,043 A * 5/1981 Kizu et al. ..... 464/83
4,691,818 A * 9/1987 Weber ..... 198/666
4,927,189 A * 5/1990 Burkit ..... 285/109
5,144,780 A * 9/1992 Gieling et al. ..... 52/298
5,149,149 A * 9/1992 Wu ..... 285/402
5,203,135 A * 4/1993 Bastian ..... 52/848
5,709,605 A * 1/1998 Riefe et al. ..... 464/83
5,921,051 A * 7/1999 Hope ..... 52/656.7
6,022,054 A * 2/2000 Hemphill et al. ..... 285/398
6,216,413 B1 * 4/2001 Lapointe ..... 52/849
6,324,988 B1 * 12/2001 Svensson ..... 104/89
6,676,326 B2 * 1/2004 Wu ..... 403/329
6,764,247 B1 * 7/2004 Kronenberg ..... 403/292
2007/0113497 A1 * 5/2007 Carless ..... 52/207
2007/0206989 A1 * 9/2007 Wagner et al. ..... 403/297

FOREIGN PATENT DOCUMENTS

EP 226654 A1 * 7/1987
JP 6-117038 4/1994
JP 06117038 A * 4/1994
JP 06257350 A * 9/1994
JP 11190179 A * 7/1999

* cited by examiner

*Primary Examiner*—Robert J Canfield
*Assistant Examiner*—Babajide Demuren
(74) *Attorney, Agent, or Firm*—Greenberg Traurig, LLP

(57) ABSTRACT

A joining structure, having a sleeve having a first end, a second end, and at least first side; at least one spacer; wherein the sleeve connects a first mullion from the first end of the sleeve and connects a second mullion from the second end of the sleeve; wherein the sleeve extends longitudinally within the first and the second mullions; wherein the at least one spacer extends longitudinally along the length of the at least first side of the sleeve and is situated between an external surface of the at least first side of the sleeve and an internal surface of at least first wall of the first mullion and an internal surface of at least first wall of the second mullion; and wherein the at least one spacer prevents direct mating between the at least first side of the sleeve and the at least first wall of the first mullion and the at least first wall of the second mullion.

8 Claims, 6 Drawing Sheets

--Prior Art--

--Prior Art--

--Prior Art--

JOINING STRUCTURE

BACKGROUND OF THE INVENTION

Curtain wall is a term used to describe a building facade which does not carry any dead load from the building other than its own dead load. These loads are transferred to the main building structure through connections at floors or columns of the building. A curtain wall is designed to resist live loads forces: air and water infiltration, wind forces, seismic forces,—and its own dead load forces. The loads imposed on the curtain wall are transferred to the building structure through the anchors which attach the mullions to the building.

A mullion is a structural element which divides adjacent window units. A mullion may also vertically divide double doors. Mullions may be made of any material, but wood and aluminum arc most common. A mullion acts as a structural member, and it carries the dead load of the weight above the opening and the wind load acting on the window unit back to the building structure. Mullions are usually spliced to allow for expansion and contraction of a curtain wall and accommodate other building movements due to live loads, creep and displacement. Adjacent mullions are generally connected with a sleeve, which is usually made of the same material from which mullions are made. Usually, when connected mullions slide along a sleeve because of movements provoked by forces of live and dead loads, noise will occur clue to surface-to-surface friction and scratching between the sleeve's surfaces and mullions' surfaces. The resulted noise is then transferred through mullions to occupied areas of the building, and resulting in nuisance for structure's tenants. Further, a use of a bond breaker tape is generally required at a face of a sleeve to prevent three-sided adhesion when sealing the mullion joints. Any structure which serves to elevate the noise resulting from the movement of mullions along the sleeve connecting two adjacent mullions; would be of significant utility for construction industry.

BRIEF SUMMARY OF THE INVENTION

A joining structure connecting two adjacent mullions of a curtain wall is disclosed herein, the disclosed joining structure alleviates the noise resulting from the movement of mullions along the sleeve connecting two adjacent mullions of a curtain wall.

According to one embodiment of the present invention, the disclosed joining structure, having a sleeve having a first end, a second end, and at least first side; at least one spacer; wherein the sleeve connects a first mullion from the first end of the sleeve and connects a second mullion from the second end of the sleeve; wherein the sleeve extends longitudinally within the first and the second mullions; wherein the at least one spacer extends longitudinally along the length of the at least first side of the sleeve and is situated between an external surface of the at least first side of the sleeve and an internal surface of at least first wall of the first mullion and an internal surface of at least first wall of the second mullion; and wherein the at least one spacer prevents direct mating between the at least first side of the sleeve and the at least first wall of the first mullion and the at least first wall of the second mullion.

In an embodiment, a second spacer is positioned between an external surface of a second side of the sleeve and an internal surface of a second wall of the first mullion and an internal surface of a second wall of the second mullion, and wherein the second spacer prevents direct mating between the second side of the sleeve and the second wall of the first mullion and the second wall of the second mullion.

In an embodiment, the first spacer prevents direct mating between more than one side of the sleeve and more than one wall of the first and second mullions.

In an embodiment, wherein the first spacer arid or the second spacer prevents direct mating between more than one side of the sleeve and more than one walls of the first and second mullions.

In an embodiment, at least one spacer is attached to the sleeve.

In an embodiment, at least one spacer is secured to a wall of at least one mullion.

In an embodiment, at least one spacer is made of or covered with a non-metal material.

In an embodiment, at least one spacer is made of or covered with a material which poorly conducts temperature.

In another embodiment, at least one spacer is made of or covered with a plastic material. In yet another embodiment, at least one spacer is made of or covered with a plastic material, which is a thermoplastic elastomer, such as Santoprene.

In an embodiment, at least one spacer is made of or covered with a material which would result in less friction upon a movement of the connected mullions along a sleeve than the friction produced by a movement of aluminum mullions along an aluminum sleeve.

For the purposes of describing and claiming the present invention, the following terms are defined:

"Plastic materials" means a synthetic or semisynthetic organic solid materials.

"Thermoplastic elastomer" means a class of copolymers or a physical mix of polymers (usually a plastic and a rubber or like materials) which consist of materials with both thermoplastic and elastomeric properties. Examples of suitable thermoplastic materials may include polyolefins such as polypropylene, and polyethylene, polyisoprene, polybutadiene, polybutene, polysiloxane, polycarbonates, polyamides, ethylene-vinyl acetate copolymers, ethylene-methacrylate copolymer, poly(vinyl chloride), polystyrene, polyesters; polyanhydrides, polyacrylianitrile, polysulfones, polyacrylic ester, acrylic, polyurethane and polyacetal, or copolymers or mixtures thereof.

"A material which poorly conducts temperature" means a material whose thermal conductivity is less than thermal conductivity of aluminum, measured at the same conditions.

BRIEF DESCRIPTION OF THE SEVERAL VIEWS OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

DETAILED DESCRIPTION OF THE INVENTION

Detailed embodiments of me present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. In addition, any measurements, specifications, and the like shown in the figures are intended to be illustrative, and not restrictive. Therefore, specific structural and functional details disclosed herein are not to be interpreted limiting, but merely as a representative basis for teaching one skilled in the art to variously employ the present invention.

Figure 1:
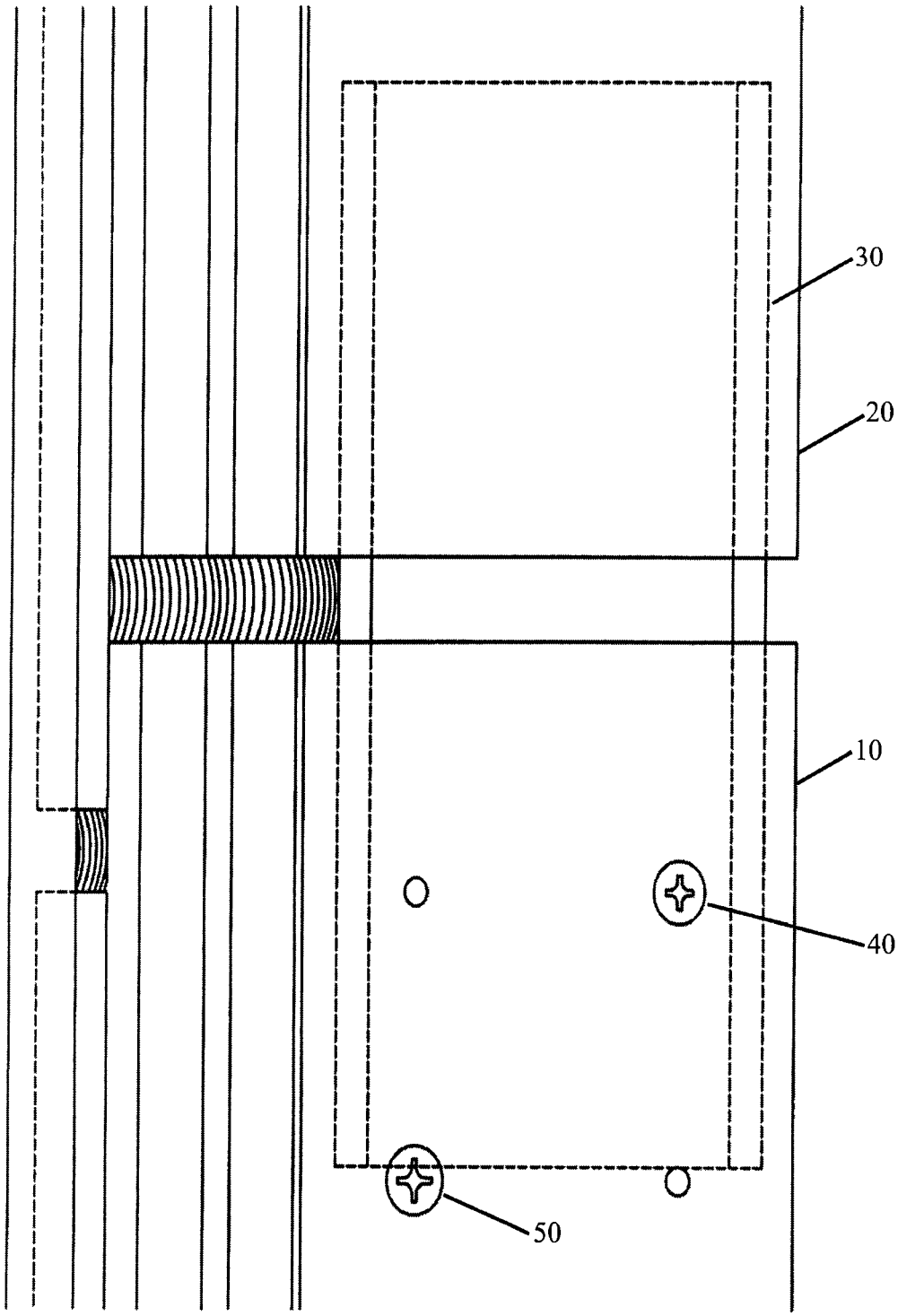
FIG. 1 depicts a side view of mullions connected with a sleeve of a joining structure, not according to the claimed invention.

FIG. 1 shows a side view of mullions connected with a sleeve of a joining structure, not according to the claimed invention. A sleeve 30 of a joining structure connects sequential mullions 20 and 10. Screws 40 and 50 secure the sleeve 30 within and or to the mullion 10.

Figure 2:
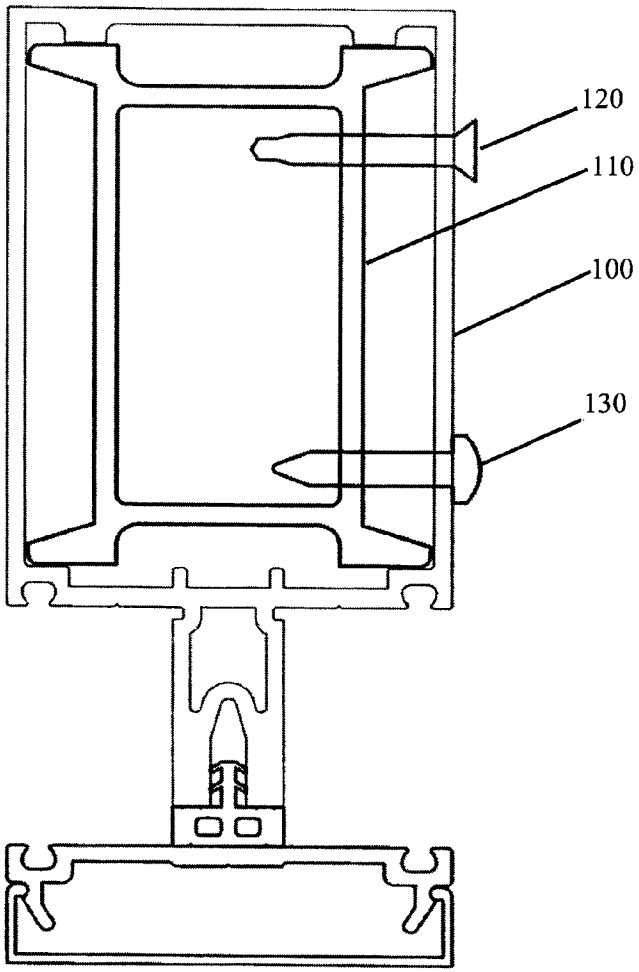
FIG. 2 depicts a cross section of a mullion with a sleeve of a joining structure, not according to the claimed invention.

FIG. 2 shows a cross section of a mullion with a sleeve, not according to the claimed invention. A sleeve 110 of a joining structure is positioned within a mullion 100. External surfaces of the sleeve 110 directly touch internal surfaces of the mullion 100. Screws 120 and 130 secure the sleeve 110 within and or to the mullion 100.

Figure 3:
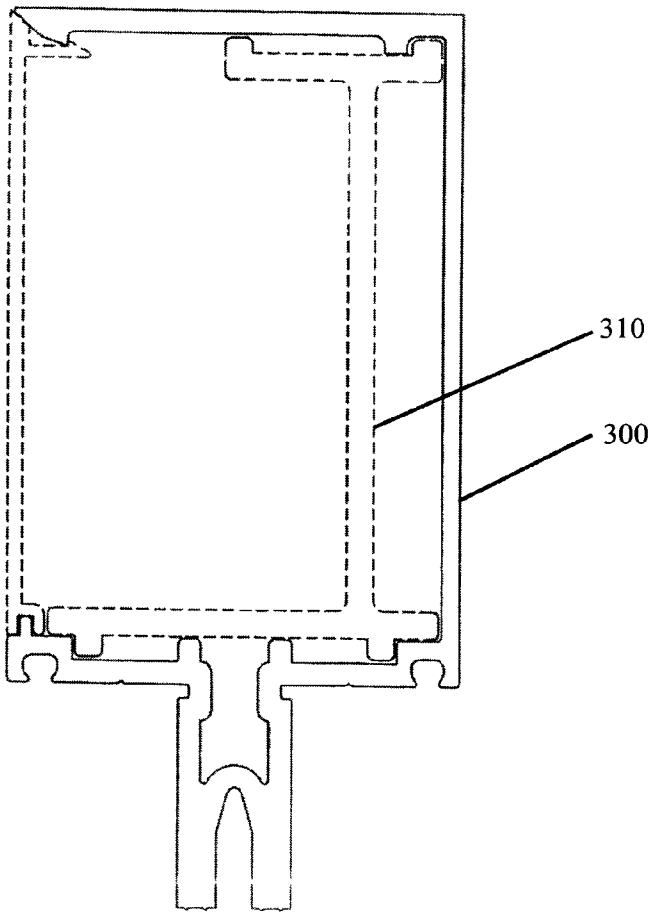
FIG. 3 depicts a cross section of a mullion with a sleeve of a joining structure, not according to the claimed invention

FIG. 3 shows a cross section of a mullion with a sleeve, not according to the claimed invention. A sleeve 310 of a joining structure is positioned within a mullion 300. External surfaces of the sleeve 310 directly touch internal surfaces of the mullion 300.

Figure 4:
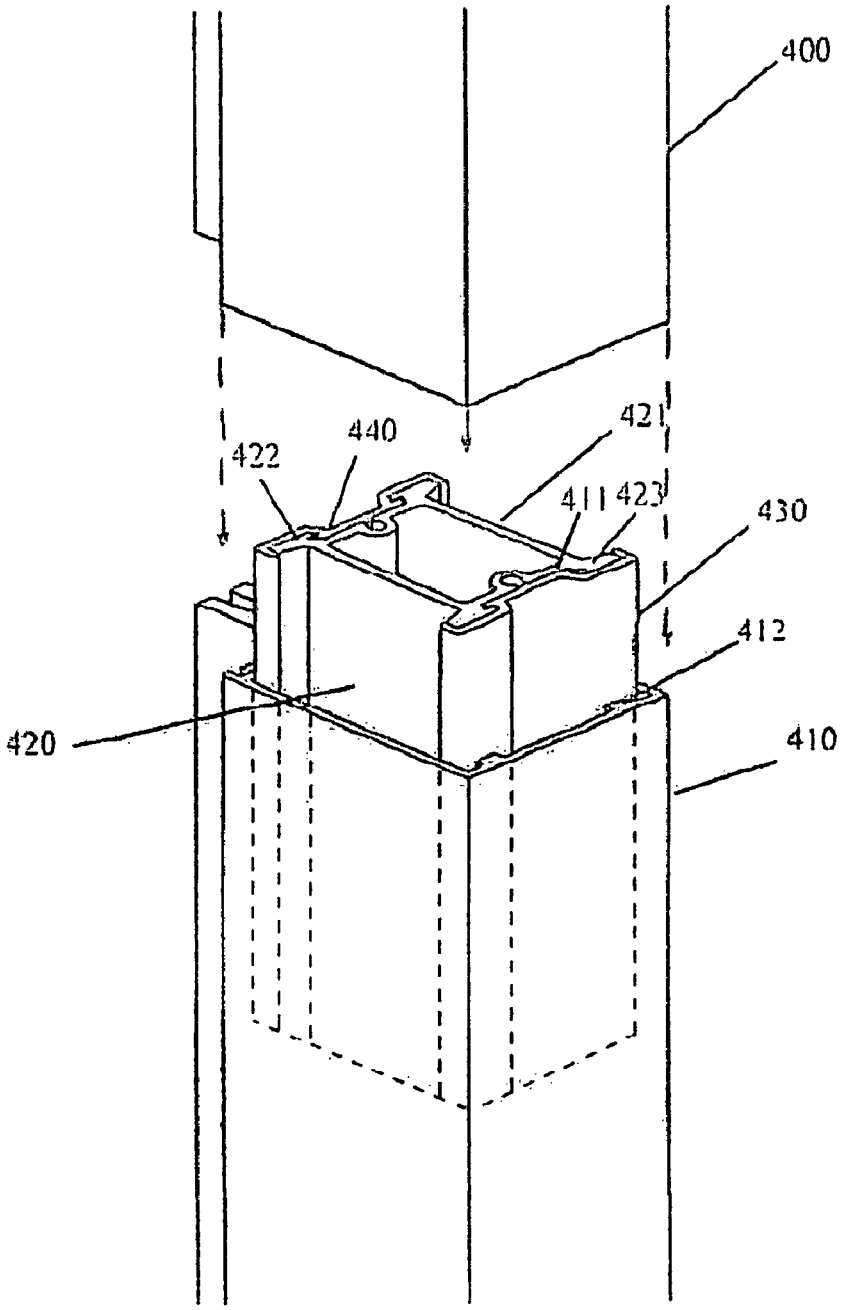
FIG. 4 depicts one embodiment of the claimed invention.

FIG. 4 shows one embodiment of a joining structure, according to the claimed invention, which joins two sequential mullions (400 and 410) of a curtain wall. The joining structure comprises of a sleeve 420 having a first end, a second end, and at least first side (422, 423); at least one spacer (430, 440); wherein the sleeve 420 connects a first mullion 400 from the first end 421 of the sleeve 420 and connects a second mullion 410 from the second end of the sleeve 420; wherein the sleeve 420 extends longitudinally within the first 400 and the second 410 mullions; wherein the at least one spacer (430, 440) extends longitudinally along the length of the at least first side of the sleeve (422, 423) and is situated between an external surface of the at least first side (422, 423) of the sleeve 420 and an internal surface 412 of at least first wall 411 of the first mullion 410 and an internal surface of at least first wall of the second mullion 400; and wherein the at least one spacer (430, 440) prevents direct mating between the at least first side 423 of the sleeve and the at least first wall 411 of the first mullion 410 and the at least first wall of the second mullion 410.

Figure 5:
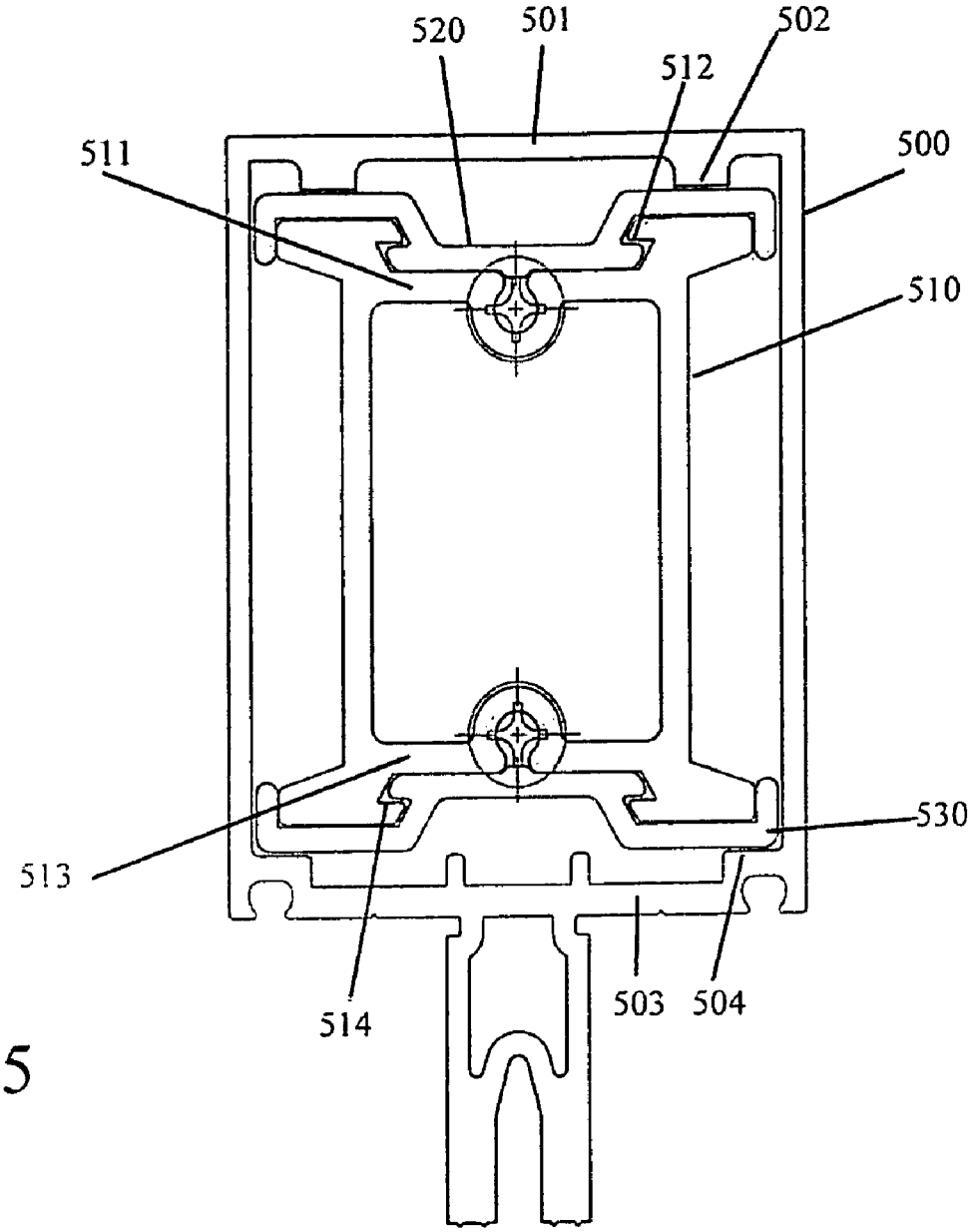
FIG. 5 depicts a cross sectional view through one of the two sequential mullions joined by an embodiment of the claimed invention.

FIG. 5 show a cross sectional view through one of the two sequential mullions of a curtain wall, joined by an embodiment of the joining structure of the claimed invention. The joining structure comprises of a sleeve 510 which is situated within a mullion 500. The joining structure further comprises of a first spacer 520 which extends longitudinally along the length of a first side 511 of the sleeve 510 and is situated between an external surface 512 of the first side 511 of the sleeve 510 and an internal surface 502 of at least one wall 501 of the mullion 500. In an embodiment, the joining structure can have a second spacer 530 which extends longitudinally along the length of a second side 513 of the sleeve 510 and is situated between an external surface 514 of the second side 513 of the sleeve 510 and an internal surface 504 of at least one wall 503 of the mullion 500, and wherein the first 520 and the second 530 spacers prevent direct mating between the inside surface of the walls of the mullion 500 and the sleeve 510.

Figure 6:
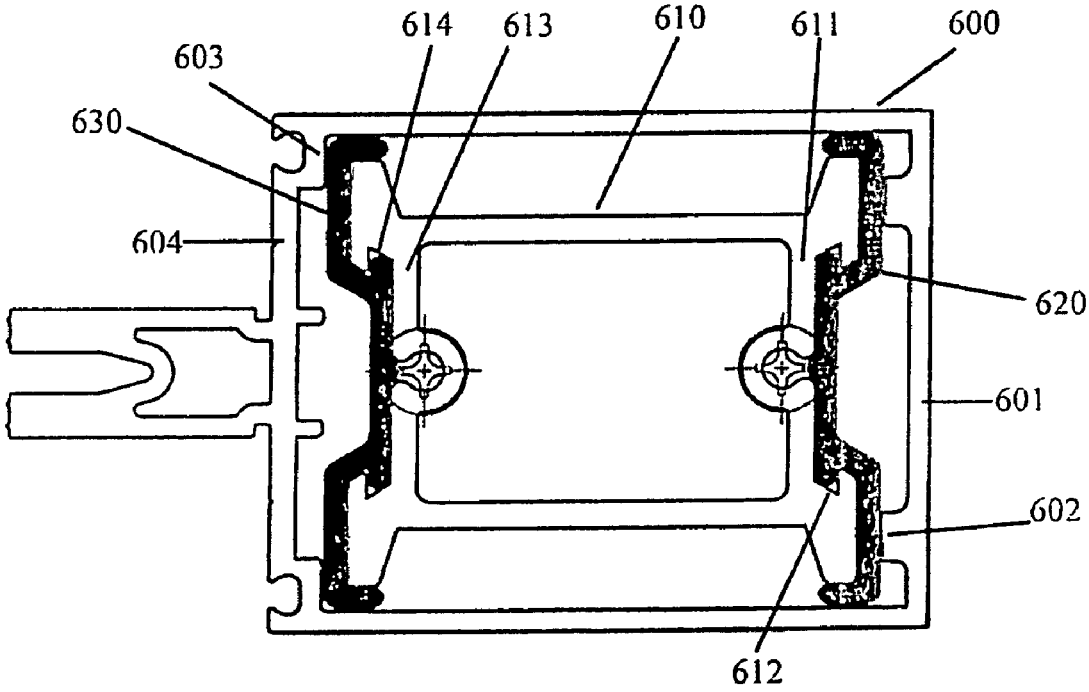
FIG. 6 depicts a cross sectional view through one of the two sequential mullions joined by another embodiment of the claimed invention.

FIG. 6 show a cross sectional view through one of the two sequential mullions of a curtain wall, joined by an embodiment of the joining structure of the claimed invention. The joining structure comprises of a sleeve 610 which is situated within a mullion 600. The joining structure further comprises of a first spacer 620 which extends longitudinally along the length of a first side 611 of the sleeve 610 and is situated between an external surface 612 of the first side 611 of the sleeve 610 and an internal surface 602 of at least one wall 601 of the mullion 600. In an embodiment, the joining structure can have a second spacer 630 which extends longitudinally along the length of a second side 613 of the sleeve 610 and is situated between an external surface 614 of the second side 613 of the sleeve 610 and an internal surface 604 of at least one wall 603 of the mullion 600, and wherein the first 620 and the second 630 spacers prevent direct mating between the inside surface of the walls of the mullion 600 arid the sleeve 610.

In another embodiment, at least one spacer is made of or covered with a non-metal material.

In another embodiment, at least one spacer is made of or covered with a material which poorly conducts temperature.

In an embodiment, at least one spacer is made of or covered with a plastic material. In yet another embodiment, at least one spacer is made of or covered with a plastic material, which is a thermoplastic elastomer, such as Santoprene.

In yet another embodiment, at least; one spacer is made of or covered with a material which would result in less friction upon a movement of the connected mullions along a sleeve than the friction produced by a movement of aluminum mullions along an aluminum sleeve.

What is claimed is:

1. A joining structure, comprising:

a sleeve having a first end, a second end, and at least a first side;

at least a first spacer;

at least a second spacer;

wherein the sleeve connects a first mullion from the first end of the sleeve and connects a second mullion from the second end of the sleeve;

wherein the sleeve connects the first mullion from the first end of the sleeve without directly contacting the first mullion;

wherein the sleeve connects the second mullion from the second end of the sleeve without directly contacting the second mullion;

wherein the sleeve extends longitudinally within the first mullion and the second mullion;

wherein the first spacer extends longitudinally along the length of the at least first side of the sleeve and is situated between an external surface of the at least first side of the sleeve and an internal surface of at least first wall of the first mullion and an internal surface of at least first wall of the second mullion;

wherein the first spacer prevents direct mating between the at least first side of the sleeve and the at least first wall of the first mullion and the at least first wall of the second mullion;

wherein the second spacer is positioned between an external surface of a second side of the sleeve and an internal surface of a second wall of the first mullion and an internal surface of a second wall of the second mullion; and wherein the second spacer prevents direct mating between the second side of the sleeve and the second wall of the first mullion and the second wall of the second mullion.

2. The structure of claim 1, wherein the first spacer prevents direct mating between more than one side of the sleeve and more than one wall of the first mullion and the second mullion.

3. The structure of claim 1, wherein at least one of the first spacer or the second spacer prevents direct mating between more than one side of the sleeve and more than one walls of the first mullion and the second mullion.

4. The structure of claim 1, wherein the first spacer is made of or covered with a non-metal material.

5. The structure of claim 1, wherein the first spacer is made of or covered with a material which poorly conducts temperature.

6. The structure of claim 1, wherein the first spacer is made of or covered with a plastic material.

7. The structure of claim 1, wherein the first spacer is made of or covered with a plastic material, which is a thermoplastic elastomer.

8. The structure of claim 1, wherein the first spacer is made of or covered with a material which would result in less friction upon a movement of the connected mullions along a sleeve than the friction produced by a movement of aluminum mullions along an aluminum sleeve.

* * * * *